United States Patent [19]

Stiles

[11] Patent Number: 4,483,155

[45] Date of Patent: Nov. 20, 1984

[54] ROOFTOP AIR CONDITIONER CONVERSION UNIT

[76] Inventor: Jack L. Stiles, P.O. Box 338, Irving, Tex. 75060

[21] Appl. No.: 392,617

[22] Filed: Jun. 28, 1982

[51] Int. Cl.[3] ..... F25D 23/12

[52] U.S. Cl. ..... 62/259.1; 62/DIG. 16

[58] Field of Search ..... 62/259.1, DIG. 16, 298; 165/47, 67, 48

[56] References Cited

U.S. PATENT DOCUMENTS

| | | | |
|---|---|---|---|
| 4,016,729 | 4/1977 | Cherry | 62/259.1 |
| 4,118,083 | 10/1978 | Lackey et al. | 62/259.1 |
| 4,403,481 | 9/1983 | Yoho, Jr. | 62/259.1 |

*Primary Examiner*—Henry Bennett

*Attorney, Agent, or Firm*—Kanz, Scherback & Timmons

[57] ABSTRACT

A plenum unit (10) for adapting roof construction for a prior rooftop air conditioning unit for use with a new air conditioning unit (12) is disclosed. A plenum (20) mounts on curbing (14) of the prior air conditioning unit. A partition (26) separates a supply chamber (22) from a return chamber (24), and an adaptor plate (28) is affixed to the plenum for mating the plenum unit with the new air conditioner unit. In one arrangement, the partition has a fixed portion and a movable portion to adjust for different size adaptor plate openings. Adaptor plates are interchangeable so that the plenum can be used with different types and sizes of new air conditioning units. In one arrangement, the ratio of intake air can be adjusted between return air from the return duct opening and fresh from the outside.

8 Claims, 5 Drawing Figures

ROOFTOP AIR CONDITIONER CONVERSION UNIT

DESCRIPTION

1. Technical Field

The present invention relates generally to systems for air conditioning and heating and, in one of its aspects, to a plenum unit for adapting roof construction for a prior rooftop air conditioning unit for use with a new air conditioning unit for a different type.

Rooftop air conditioning units designed to blow directly downward so that the supply and return air ducts open directly below the air conditioning unit have been extensively installed over the last two decades. These units are fast wearing out and need to be replaced. Air conditioning units have been greatly improved over the years since those units were first installed so that the same units are no longer being manufactured. The new units are designed for new installations and not for retrofitting so that the supply duct opening, the return duct opening and curbing for supporting the prior air conditioning unit do not fit the new units. Purchasers of the new units for replacing older rooftop units have had to tear out and rebuild roof structure, remove and replace the old curbing and modify existing duct work in order to install the new units. These conversions have been costly and involved considerable down time for air conditioning.

2. Disclosure of Invention

A plenum unit according to the present invention for adapting roof construction for a prior rooftop air conditioning unit for use with a new air conditioning unit of the type which is different from the prior unit includes a plenum adapted to mount on the existing curbing, a partition separating the plenum into a supply chamber and a return chamber and an adaptor plate affixed to the plenum. The supply chamber is in open communication with the supply duct opening in the roof and the return chamber is in open communication with the return duct opening. The adaptor plate forms a supply opening for mating with the supply air opening of the new air conditioning unit and a return opening for mating with the return air opening. The partition extends to near proximity to the adaptor plate between the supply opening and the return opening so that the return air opening of the new unit is in open communication with the return chamber of the plenum and the supply air opening of the new unit is in open communication with the supply chamber of the plenum and the chambers are substantially separated from each other.

A preferred form of the partition includes a fixed portion and a movable portion for connecting between the fixed portion and a location in near proximity to the adaptor plate. The end of the movable portion in near proximity to the adaptor plate can be adjusted to be between the supply opening and the return opening of the adaptor plate for different relative sizes of the openings. This is especially useful for an adaptor plate which is removably affixed to the plenum so that only adaptor plates need to be interchanged for use of the plenum unit with different types and sizes of air conditioning units. The adaptor plate end of the partition can be fixed in position once it has been adjusted for the particular adaptor plate.

A preferred form of the plenum unit also includes means associated with the return chamber of the plenum for adjusting the ratio of intake air between return air from the return duct opening and fresh air from outside the plenum.

BEST MODE FOR CARRYING OUT THE INVENTION

Figure 1:
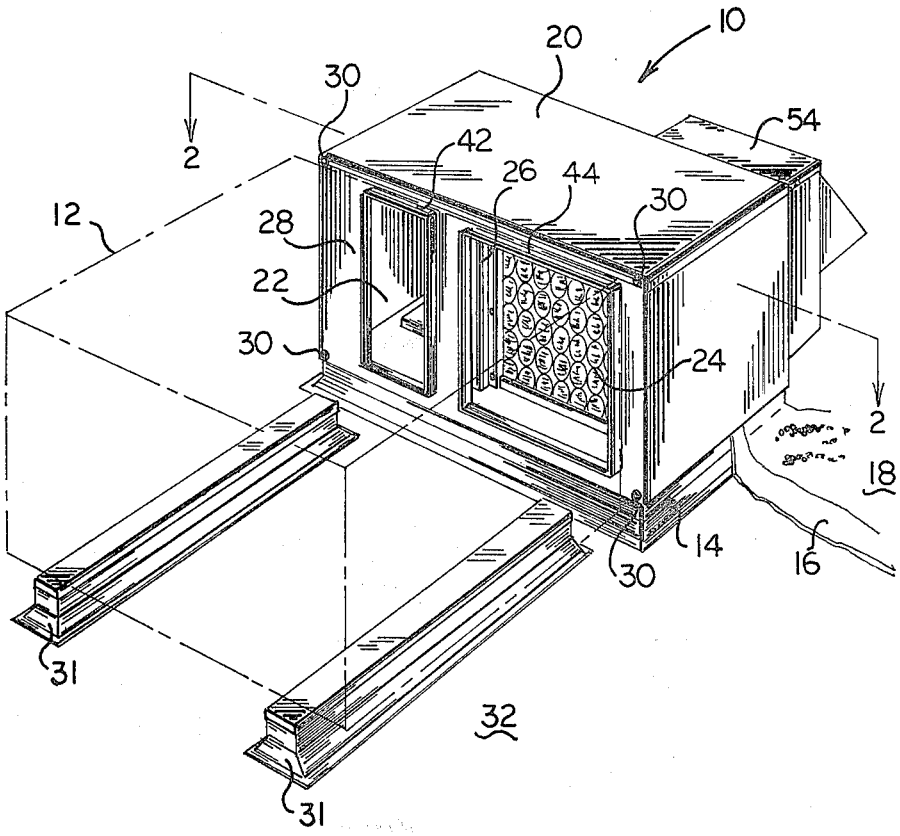
FIG. 1 is a perspective view of a plenum unit according to the present invention installed on roof construction for a prior rooftop air conditioning unit which has been removed shown in relationship to a new air conditioning unit shown in phantom lines.

Referring now to the drawing, and in particular to FIG. 1, a plenum unit according to the present invention is referred to generally by reference numeral 10. Plenum unit 10 is for adapting roof construction for a prior rooftop air conditioning unit which is not shown but is well known in the art for use with a new air conditioning unit 12 of a type which is different from the prior unit. The roof construction includes curbing 14 which was originally used for supporting the prior air conditioning unit and is now used for supporting plenum unit 10, plenum 10 occupying essentially the same space that had been used by the prior air conditioning unit. Roof construction also includes roofing material 16 along with tar and gravel 18. Plenum unit 10 includes plenum 20 adapted to mount on curbing 14. Plenum 20 forms a supply chamber 22 and a return chamber 24. A partition 26 separates supply chamber 22 from return chamber 24.

An adaptor plate 28 is removably affixed to plenum 20 by means of screws 30 which could also be bolts and wing nuts or other releasable means. One form of the plenum unit also includes equipment support 31 mounted on roof 32 for supporting the new air conditioning unit in a position for mating with plenum unit 10.

Figure 2:
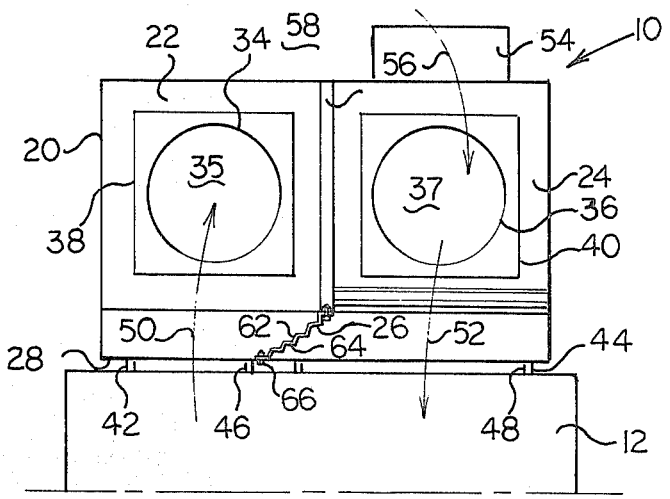
FIG. 2 is a sectional view of the plenum unit of FIG. 1 taken along lines 2—2.

Referring also to FIG. 2, the roof construction for the prior air conditioning unit also includes an air supply duct opening 34 and an air return duct opening 36 which lead to the supply and return ducts of the building, 35 and 37 respectively. Supply chamber 22 is in open communication with air supply duct opening 34 to opening 38 and return chamber 24 is in open communication with return duct opening 36 through opening 40.

Adaptor plate 28 forms a supply opening 42 and a return opening 44 for mating with supply air opening 46 and return air opening 48 of new air conditioning unit 12. It can now be seen that supply air 50 can be blown from new air conditioning unit 12 through openings 42, 46, 38 and 34 directly to supply duct 35. Similarly return air 52 can be drawn directly from return air duct 37 through openings 36, 40, 44 and 48 directly to air conditioning unit 12.

A preferred form of plenum 10 also includes means 54 for admitting fresh air 56 from the outside 58 so that fresh air is mixed with return air from return duct 37 before being returned to new air conditioning unit 12.

A preferred form of partition 26 includes a fixed portion 60 and a movable portion 62 which is normarlly flexible and in this case is of a corrugated or accordion type construction. Movable portion 62 connects between fixed portion 60 and a location in near proximity to adaptor plate 28. End 64 of movable portion 62 which is in near proximity to the adaptor plate can be adjusted to be attached between supply opening 42 and return opening 44 of the adaptor plate so that it can be adjusted for the different relative sizes of the openings. The relative size of those openings will be determined by the relative sizes of supply air opening 46 and return air opening 48 of the new air conditioning unit. Means 66 fixes the position of adaptor plate end 64 of partition 28 once that end has been adjusted for the particular adaptor plate. One suitable means 66 would be simply a small securing plate held in place by several bolts vertically spaced along the height of end 62.

Figure 4:
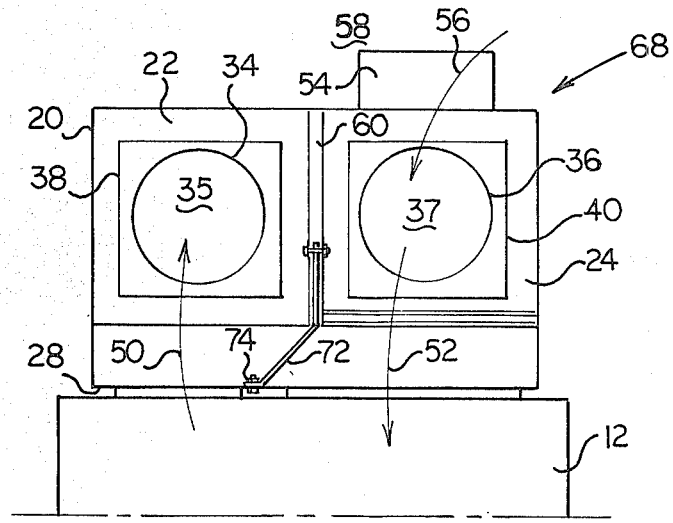
FIG. 4 is a sectional view of the plenum unit of FIG. 3 taken along lines 4—4.
Figure 3:
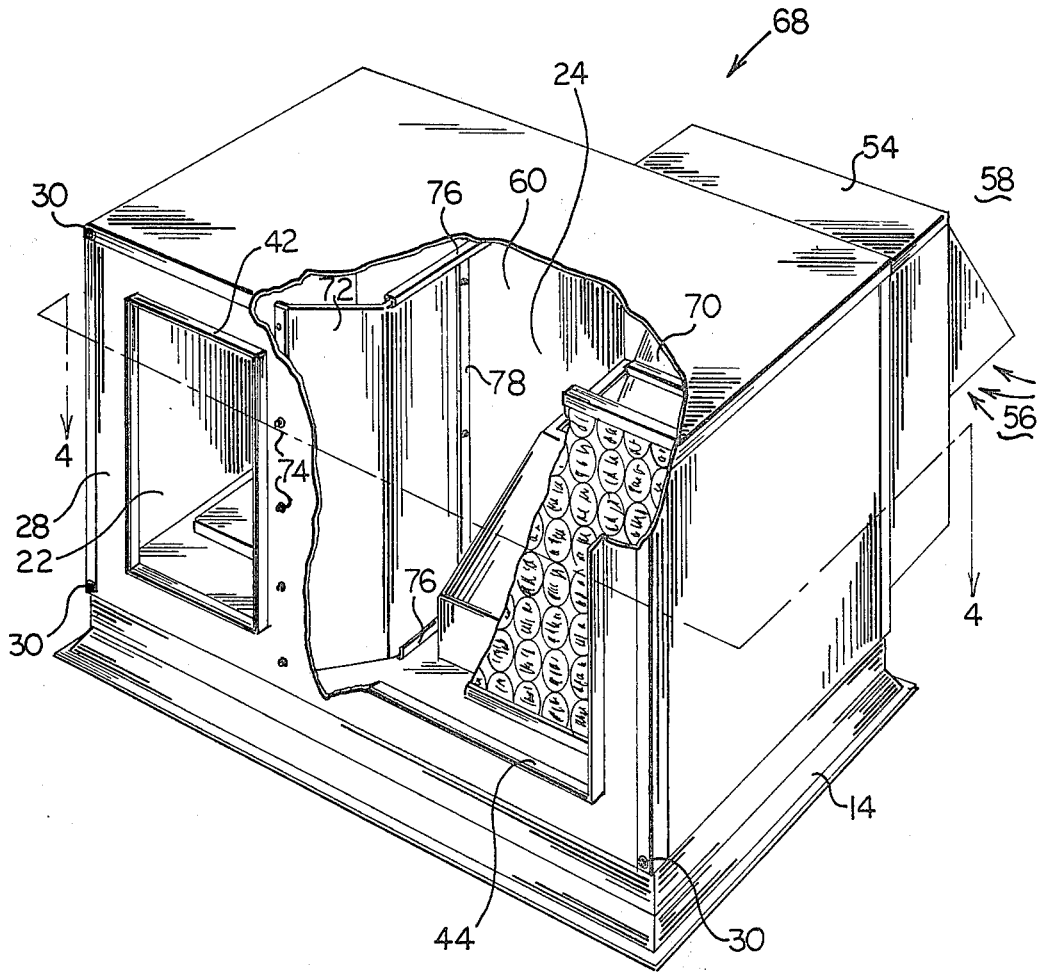
FIG. 3 is a perspective view in partial cutaway of another plenum unit according to the present invention.

Referring now to FIG. 3 and FIG. 4, an alternative embodiment of a plenum unit according to the present invention is referred to generally by reference numeral 68 where like numerals are used to refer to like parts in plenum unit 10. As seen most clearly in FIG. 3, a plenum unit 68 according to the present invention also includes means 70 associated with return chamber 24 of plenum 20 for adjusting the ratio in intake air 52 between air from return duct opening 37 and fresh air 56 from the outside 58. Means 70 can simply be a damper adjustable through a continuum of positions between one completely closing off the outside air and opening return duct 37 and one completely closing off return duct 37 and completely opening to the outside air.

A movable portion of the partition is represented by reference numeral 72. Movable portion 72 is made of a flexible thick rubber material which is connected to adaptor plate 28 at one end by vertically spaced bolts 74 and is held in slider 76 by slider rod 78.

Figure 5:
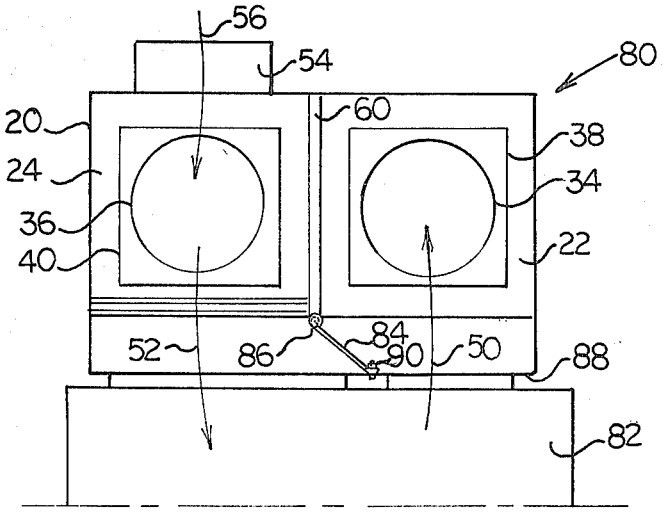
FIG. 5 is a view similar to that of FIG. 3 and FIG. 4 for yet another form of a plenum unit according to the present invention.

Referring now to FIG. 5, yet another embodiment of a plenum unit according to the present invention as referred to generally by reference numeral 80 where like elements are referred to by like numerals although the elements are largely reversed in a mirror image fashion from of plenum units 10 and 68 since new air conditioning unit 82 has its supply and return reversed from new air conditioning unit 12. A movable portion of the partition is referred to by reference numeral 84. Movable portion 84 is made of a flexible sheet type material which can be easily wound about a window shade type roller 86 and drawn out to attach to adaptor plate 88 by vertically spaced bolts 90.

It can now be seen that by use of a plenum unit according to the present invention, a prior rooftop air conditioning unit can be replaced by a new unit by removing the old unit and installing a plenum unit according to the present invention in its place using the exisiting rooftop construction for the installation of the plenum unit. Since the plenum unit is relatively inexpensive and easy to manufacture in comparsion to a new air conditioning unit, plenum units can be tailor-made to fit the prior air conditioning unit's roof construction. A certain size and shape of plenum unit can be made to correspond exactly to a certain type of prior air conditioning unit, and adaptor plates can be made to mate with the new air conditioning units so that any combination of prior air conditioning unit and new air conditioning unit can be easily accommodated. Once the new plenum unit is in place and the proper adaptor plate is affixed to the plenum unit, then the new air conditioning unit can be put into place on its equipment support so that it mates with the plenum unit.

From the foregoing it will be seen that this invention is one well adapted to attain all of the ends and objects hereinabove set forth, together with other advantages which are obvious and which are inherent to the apparatus.

It will be understood that certain features and subcombinations are of utiility and may be employed without reference to other features and subcombinations. This is comtemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A plenum unit for adapting roof construction for a prior rooftop air conditioning unit for use with a new air conditioning unit of a type which is different from the prior unit and having a supply air opening and a return air opening wherein the roof construction includes an air supply duct opening, an air return opening and curbing for supporting the prior air conditioning unit, the plenum unit comprising, in combination:

a plenum adapted to mount on the curbing, forming a supply chamber in open communication with the supply duct opening and a return chamber in open communication with the return duct opening;

a partition separating the supply chamber from the return chamber;

an adaptor plate affixed to the plenum forming a supply opening for mating with the supply air opening of the new air conditioning unit and a return opening for mating with the return air opening of the new air conditioning unit wherein the partition extends to near proximity to the adaptor plate between the supply opening and the return opening whereby the return air opening of the new unit is in open communication with the return chamber of the plenum and the supply air opening of the new unit is in open communication with the supply chamber of the plenum; and equipment support adapted to mount on the roof for supporting the new air conditioning unit to the side of the plenum in a position for mating with the adaptor plate.

2. A plenum unit for adapting roof construction for a prior rooftop air conditioning unit for use with a new air conditioning unit of a type which is different from the prior unit and having a supply air opening and a return air opening wherein the roof construction includes an air supply duct opening, an air return duct opening and curbing for supporting the prior air conditioning unit, the plenum unit comprising, in combination:

a plenum adapted to mount on the curbing, forming a supply chamber in open communication with the supply duct opening and a return chamber in open communication with the return duct opening;

a partition separating the supply chamber from the return chamber;

an adaptor plate affixed to the plenum forming a supply opening for mating with the supply air opening of the new air conditioning unit and a return opening for mating with the return air opening of the new air conditioning unit wherein the partition extends to near proximity to the adaptor plate between the supply opening and the return opening whereby the return air opening of the new unit is in open communication with the return chamber of the plenum and the supply air opening of the new unit is in open communication with the supply chamber of the plenum; and equipment support adapted to mount on the roof for supporting the new air conditioning unit in a position for mating with the adaptor plate;

wherein the partition separating the supply side chamber from the return chamber comprises:

a fixed portion;

a movable portion for connecting between the fixed portion and near proximity to the adaptor plate wherein the end of the movable portion in near proximity to the adaptor plate can be adjusted to be between the supply opening and the return opening of the adaptor plate for different relative sizes of the openings; and means for fixing the position of the adaptor plate end of the partition once the adaptor plate end has been adjusted for the particular adaptor plate.

3. A plenum unit according to claim 2 wherein the adaptor plate is removably affixed to the plenum whereby only the adaptor plate needs to be interchanged for use of the plenum unit with different types and sizes of new air conditioning units.

4. A plenum unit according to claim 3 further comprising:

means for admitting fresh air from the outside into the return chamber; and means associated with the return chamber of the plenum for adjusting the ratio of intake air between return air from the return duct opening and fresh air from the outside.

5. A plenum unit for adapting roof construction for a prior rooftop air conditioning unit for use with a new air conditioning unit of a type which is different from the prior unit and having a supply air opening and a return air opening wherein the roof construction includes an air supply duct opening, an air return duct opening and curbing for supporting the prior air conditioning unit, the plenum unit comprising, in combination:

a plenum adapted to mount on the curbing, forming a supply chamber in open communication with the supply duct opening and a return chamber in open communication with the return duct opening;

a partition separating the supply chamber from the return chamber;

an adaptor plate affixed to the plenum forming a supply opening for mating with the supply air opening of the new air conditioning unit and a return opening for mating with the return air opening of the new air conditioning unit wherein the partition extends to near proximity to the adaptor plate between the supply opening and the return opening whereby the return air opening of the new unit is in open communication with the return chamber of the plenum and the supply air opening of the new unit is in open communication with the supply chamber of the plenum; and.

equipment support adapted to mount on the roof for supporting the new air conditioning unit in a position for mating with the adaptor plate;

wherein the adaptor plate is removably affixed to the plenum whereby only the adaptor plate needs to be interchanged for use of the plenum unit with different types and sizes of new air conditioning units.

6. A plenum unit for adapting roof construction for a prior rooftop air conditioning unit for use with a new air conditioning unit of a type which is different from the prior unit and having a supply air opening and a return air opening wherein the roof construction includes an air supply duct opening, an air return duct opening and curbing for supporting the prior air conditioning unit, the plenum unit comprising, in combbination:

a plenum adapted to mount on the curbing, forming a supply chamber in open communication with the supply duct opening and a return chamber in open communication with the return duct opening;

a partition separating the supply chamber from the return chamber; and an adaptor plate affixed to the plenum forming a supply opening for mating with the supply air opening of the new air conditioning unit and a return opening for mating with the return air opening of the new air conditioning unit wherein the partition extends to near proximity to the adaptor plate between the supply opening and the return opening whereby the return air opening of the new unit is in open communication with the return chamber of the plenum and the supply air opening of the new unit is in open communication with the supply chamber of the plenum;

wherein the partition separating the supply side chamber from the return comprises:

a fixed portion;

a movable portion for connecting between the fixed portion in near proximity to the adaptor plate wherein the end of the movable portion in near proximity to the adaptor plate can be adjusted to be between the supply opening and the return opening of the adaptor plate for different relative sizes of the openings; and means for fixing the position of the adaptor plate end of the partition once the adaptor plate end has been adjusted for the particular adaptor plate.

7. A plenum unit according to claim 6 wherein the adaptor plate is removably affixed to the plenum whereby only the adaptor plate needs to be interchanged for use of the plenum unit with different types and sizes of new air conditioning units.

8. A plenum unit according to claim 7 further comprising:

means for admitting fresh air from the outside into the return chamber; and means associated with the return chamber of the plenum for adjusting the ratio of intake air between return air from the return duct opening and fresh air from the outside.

* * * * *